US005699566A

United States Patent [19]

Chuang

[11] Patent Number: 5,699,566

[45] Date of Patent: Dec. 23, 1997

[54] SICKBED

[76] Inventor: Ching-Shan Chuang, Hou-Bei Shaing, Tainan, Taiwan

[21] Appl. No.: 660,269

[22] Filed: Jun. 7, 1996

[51] Int. Cl.[6] ..... A61G 7/008; A61G 7/015

[52] U.S. Cl. ..... 5/613; 5/618; 5/934

[58] Field of Search ..... 5/81.1, 613, 617, 5/618, 933, 934

[56] References Cited

U.S. PATENT DOCUMENTS

| | | | |
|---|---|---|---|
| 2,112,702 | 3/1938 | Loibl | 5/934 |
| 4,658,450 | 4/1987 | Thompson | 5/618 |
| 5,125,122 | 6/1992 | Chen | 5/613 |
| 5,224,228 | 7/1993 | Larrimore | 5/613 |
| 5,303,437 | 4/1994 | Hung | 5/617 |
| 5,392,479 | 2/1995 | Liao | 5/618 |

FOREIGN PATENT DOCUMENTS

| | | | |
|---|---|---|---|
| 855112 | 11/1960 | United Kingdom | 5/618 |

*Primary Examiner*—Steven N. Meyers
*Assistant Examiner*—Robert G. Santos
*Attorney, Agent, or Firm*—Pro-Techtor International

[57] ABSTRACT

A sickbed, comprising: a first bed frame, provided with a plurality of fixed bed planks of mutual distance to support the patient's body and allow him to sit up or lift the legs, thus changing his posture; a second bed frame, vertically movably mounted below the first bed frame; a plurality of movable bed planks, which are mounted on said second bed frame, at a suitable height above said second bed frame, keeping certain distances from each other and being placed in gaps between said fixed bed planks; a first driving device to drive the second bed frame's movement up and down; and a second driving device to drive the first bed frame. Its improved parts include two lateral turning frames to help the patient to turn around, each further comprising a shaft and a plurality of parallel support planks of mutual distance, which are mounted on said shaft, placed in gaps between the fixed bed planks and the movable bed planks, and are movable in a rotary movement as driven by said shaft. The movable bed planks protrude from the fixed bed planks or sink below them, changing the parts of the patient's body exposed to pressure. The lateral turning frames help to turn around the patient's body and to change the patient's lying posture.

8 Claims, 10 Drawing Sheets

SICKBED

TECHNICAL FIELD

This invention relates to a sickbed, particularly to a sickbed for persons having long-term diseases or for disabled sick persons.

BACKGROUND ART

In beds of common people, mostly a mattress is placed on a frame and in turn covered by bedclothes. With an arrangement like this, the area of the skin in direct contact with the bed will some time after going to bed suffer from inhibited blood circulation or damp heat. People then feel uncomfortable and need to turn around. At times, when the weather is hot, it becomes even impossible for the whole night to fall asleep. This is uncomfortable for ordinary persons, but becomes more troublesome for sick persons. A lightly sick person still can turn around by himself, severely sick persons, however, like those affected by bone fractures, spine injuries, concussions of the brain or those being in a vegetative state, have no way of turning around by themselves. When they lie on the bed without ventilation, with their skin and the bed in contact for a long time, the blood circulation is inhibited, after some time the skin becomes red and swollen, and in serious cases eczemas or ulcers develop. So, to prevent this from happening, relatives or clinic personnel have to turn around, massage or wash the body. Thus human and material resources are used up, and the psychological burden is large.

SUMMARY OF THE INVENTION

The main objective of this invention consists in providing a sickbed, which permanently changes the pressure points on the patient's body, increases ventilation and, by massaging the body, furthers blood circulation to prevent bedsore.

A further objective of this invention consists in providing a sickbed, which helps the patient to change the body position to increase the patient's comfort and which prevents muscular atrophy.

A further objective of this invention consists in providing a sickbed, which supports nursing efforts.

These objectives as well as further advantages will become apparent by the following description and claims, taken in conjunction with the accompanying drawings.

BEST MODE FOR CARRYING OUT THE INVENTION

As shown in all figures, this invention's sickbed automatically regulates the patient's posture, letting him sit up or turn around. It massages the patient's body and furthers his blood circulation. So this invention's sickbed does not allow bedsore to develop easily, it moves the patient's body parts and prevents muscular atrophy.

Figure 1:
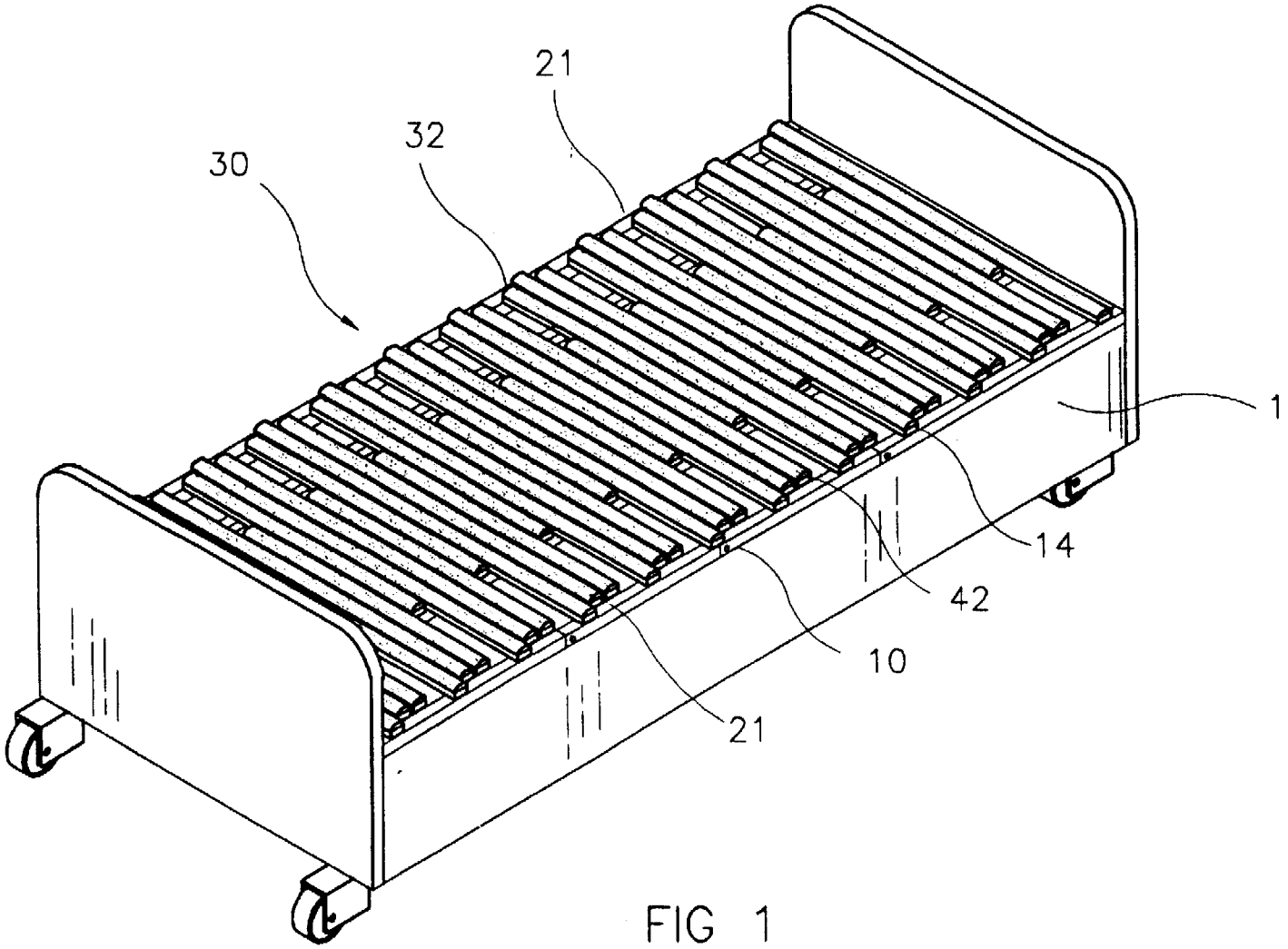
FIG. 1 is a three-dimensional view of a first embodiment of this invention.
Figure 2:
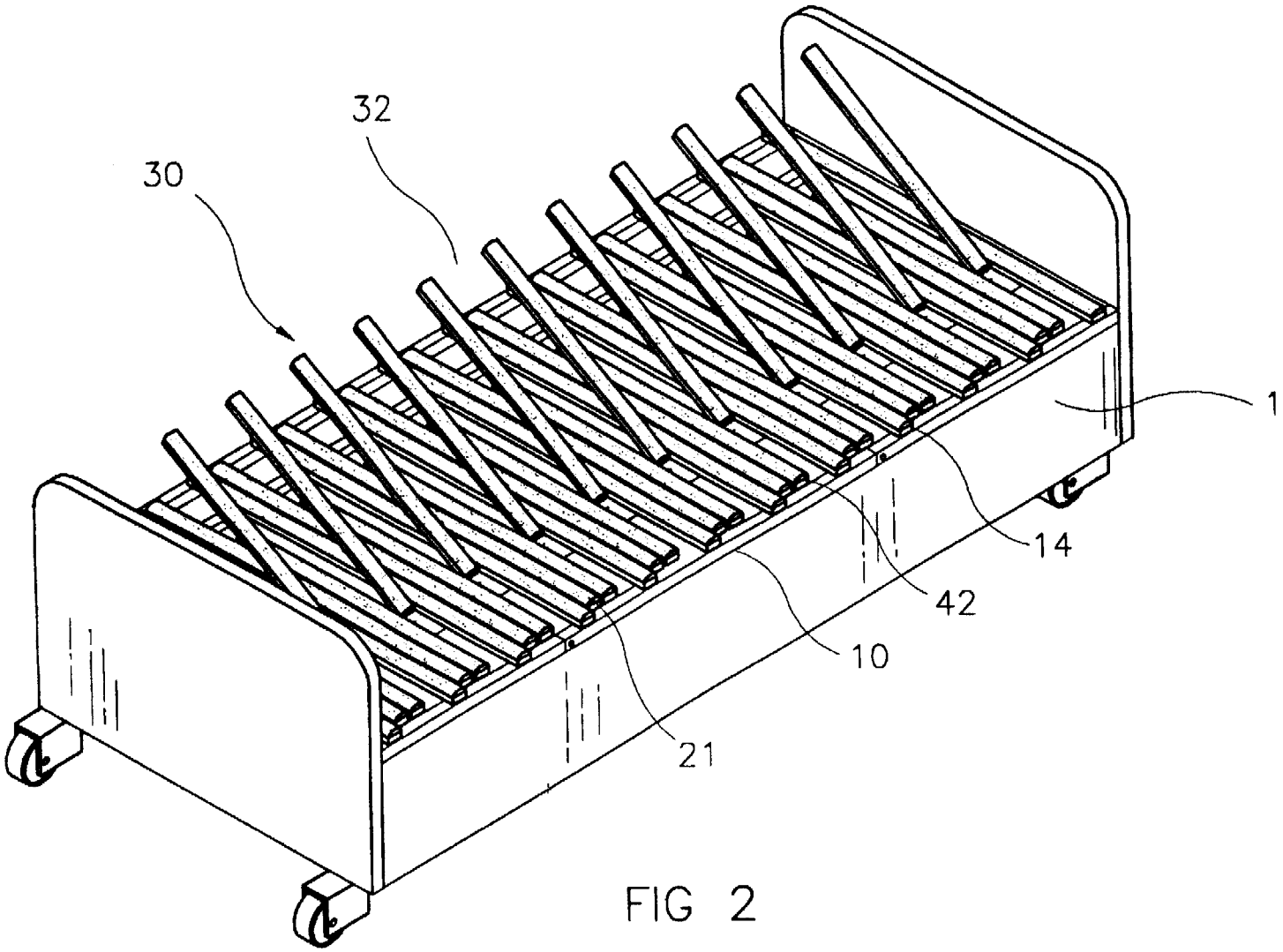
FIG. 2 is a three-dimensional view to show the lateral turning frame of this invention's sickbed in an elevated state.

As shown in FIG. 1 and 2, this invention's sickbed in the first embodiment mainly comprises: a base frame 1; a first bed frame 10, which is mounted on the base frame and can regulate the patient's posture; a second bed frame 20, which is mounted below the first bed frame 10, while being movable up and down; two lateral turning frames 30 and 40 to have the patient's body turned; a first driving device 50 to drive the second bed frame 20; and a second driving device 60 to drive the first bed frame 10.

Figure 3:
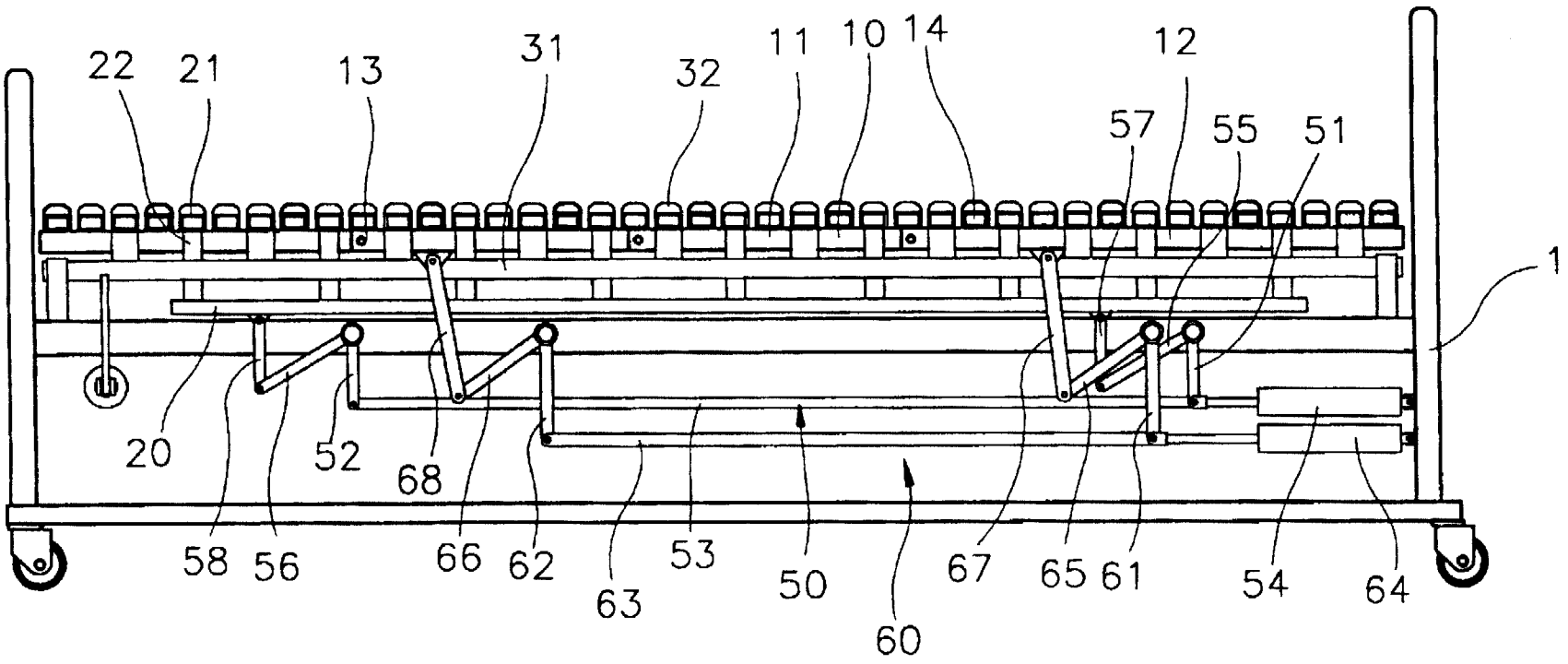
FIG. 3 is a schematic elevational view of this invention's sickbed to show the connection of all parts of this invention and the structure of the first driving device.

As shown in FIG. 1 and 3, this invention's first bed frame 10 has a central part 11, which is fastened to base frame 1, and two movable parts 12 and 13, which are hingedly mounted on the front end and the back end of the central part 11. The first movable part 12 serves as a rest for the patient's head and back. When undergoing a push from the second driving device 60 it tilts upwards to a certain angle and lifts the patient's upper part of the body to let him lie inclined or sit up. The second movable part 13 serves as a rest for the patient's lower half of the body. When undergoing a push from the second driving device 60 it tilts upwards to a certain angle and lifts the patient's legs.

The central part 11 of the first bed frame 10 and the first and second movable part 12 and 13 essentially form a rectangle. On it, many transversal, parallel fixed bed planks 14 are mounted keeping certain mutual distances. In a normal state, this bed frame supports the patient.

The second bed frame 20 is movable vertically upwards and downwards, as driven by the first driving device 50. On this movable bed frame 20 many movable bed planks 21 are mounted. All movable bed planks 21 are mounted keeping certain mutual distances. Each of them is placed in one of the gaps left by the fixed bed planks 14. The fixed bed planks 14 and the movable bed planks 21 maintain suitable distances to accommodate the lateral turning frames 30 and 40 (see below) and to allow for ventilation. A ventilator may be installed below the bed to increase the ventilation effect.

The second bed frame 20 stays at a suitable position below the first bed frame 10. On both sides of it several supports 52 are mounted separately to support the movable bed planks 21. In a regular state, the movable bed planks 21, supported by the supports 52, stay below the fixed bed planks 14, and the first bed frame 10 carries the patient. When the movable bed planks 21 are vertically moved, they will be elevated to a suitable level and take over carrying the patient's weight. It should be noted here that the elevation of the movable bed planks 21 must exceed the thickness of the fixed bed planks 14 to let the movable bed planks 21 protrude from the fixed bed planks 14 at the time of the vertical movement.

Figure 4:
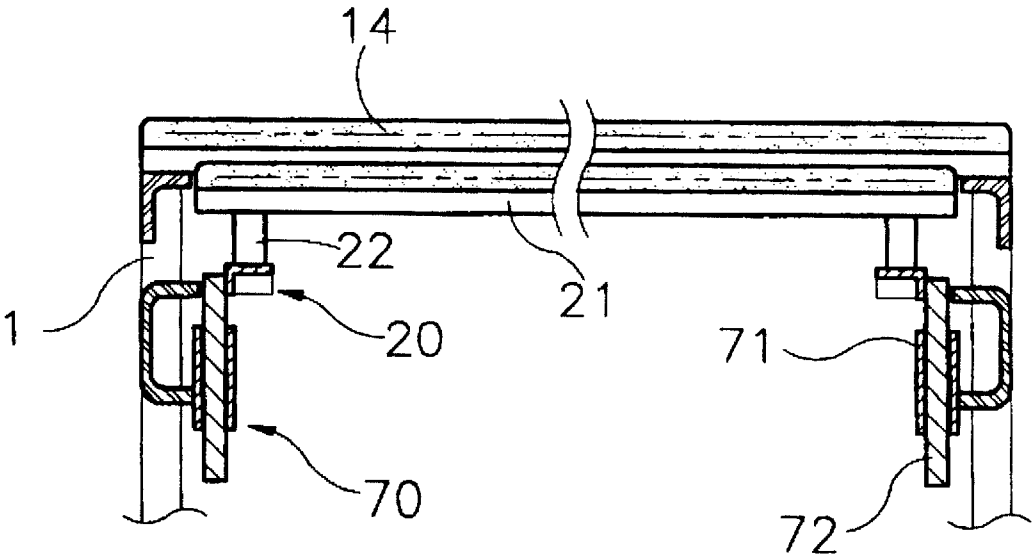
FIG. 4 is a schematic cross-sectional view of this invention's sickbed system to show the construction of a guiding device used to guide the second bed frame of this invention's sickbed.

In order to avoid any jamming of the movable bed planks 21 due to a horizontal displacement when they move up and down, several guiding devices 70 are mounted on both sides of the first bed frame 10 and on the second bed frame 20. As shown in FIG. 4, a guiding device comprises a guiding sleeve 71, which is fastened to both sides of the first bed frame 10, and a guiding rod 72, which is fastened to the second bed frame 20 and which is movable up and down within the guiding sleeve 71. So when the second bed frame 20 moves up and down, it will not be displaced horizontally and block the planks.

As shown in FIG. 3, the first driving device 50 mainly comprises: at least two toggle links 51 and 52, each being with a pivot attached to the base frame 1; a link shaft 53, connecting to the toggle links 51 and 52; 5 and a power device 54, which is mounted on the base frame 1 and drives the link shaft 53 and the toggle links 51 and 52 back and forth. On the toggle links 51 and 52, at the ends that are pivoted to the base frame 1, two links 55 and 56 are attached, respectively, maintaining a fixed angle with the toggle links 51 and 52. A plurality of link rods 57 and 58 connect the other end of the links 55 and 56, respectively, to the second bed frame 20.

In the above embodiment, the power device 54 works by compressed air or oil pressure, driving the toggle links 51 and 52 along with the links 55 and 56 back and forth, thereby driving the link rods 57 and 58 up and down. So it causes the second bed frame 20 and with it the movable bed planks 21 to shift up and down.

Figure 5:
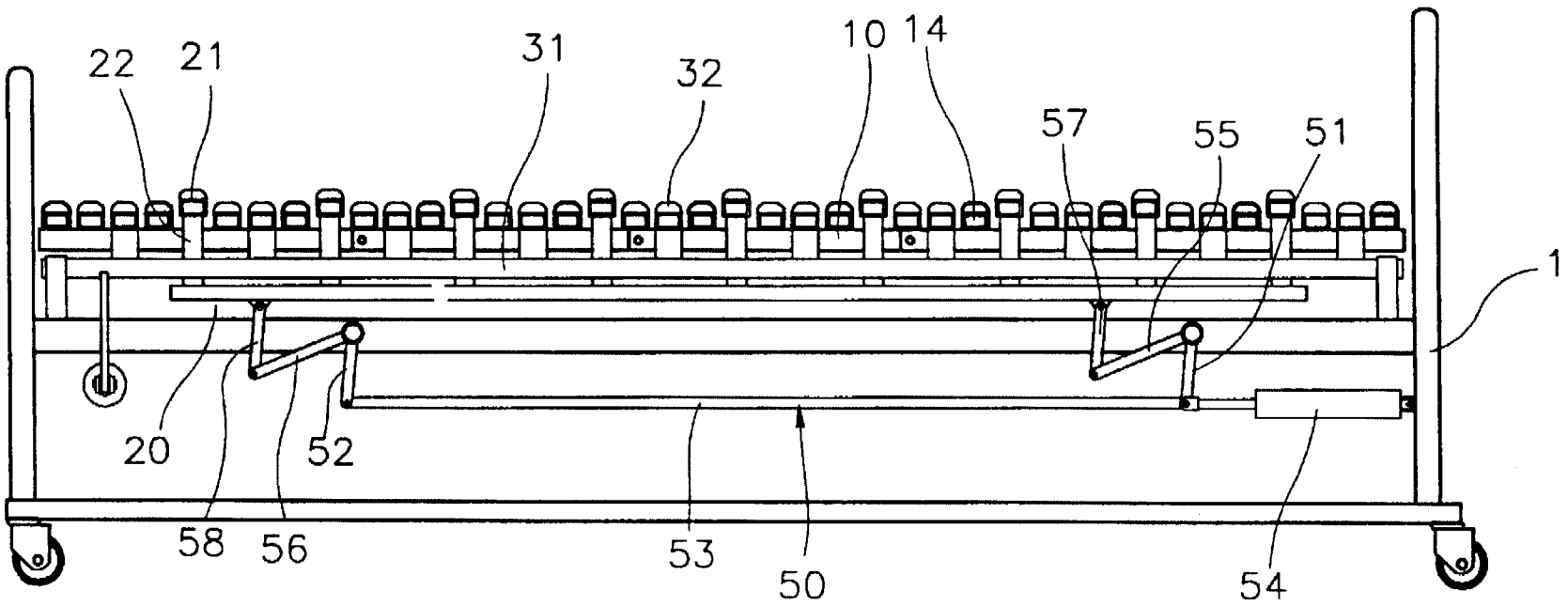
FIG. 5 and 6 are schematic illustrations to show the movement of this invention's second bed frame and movable bed planks.
Figure 6:
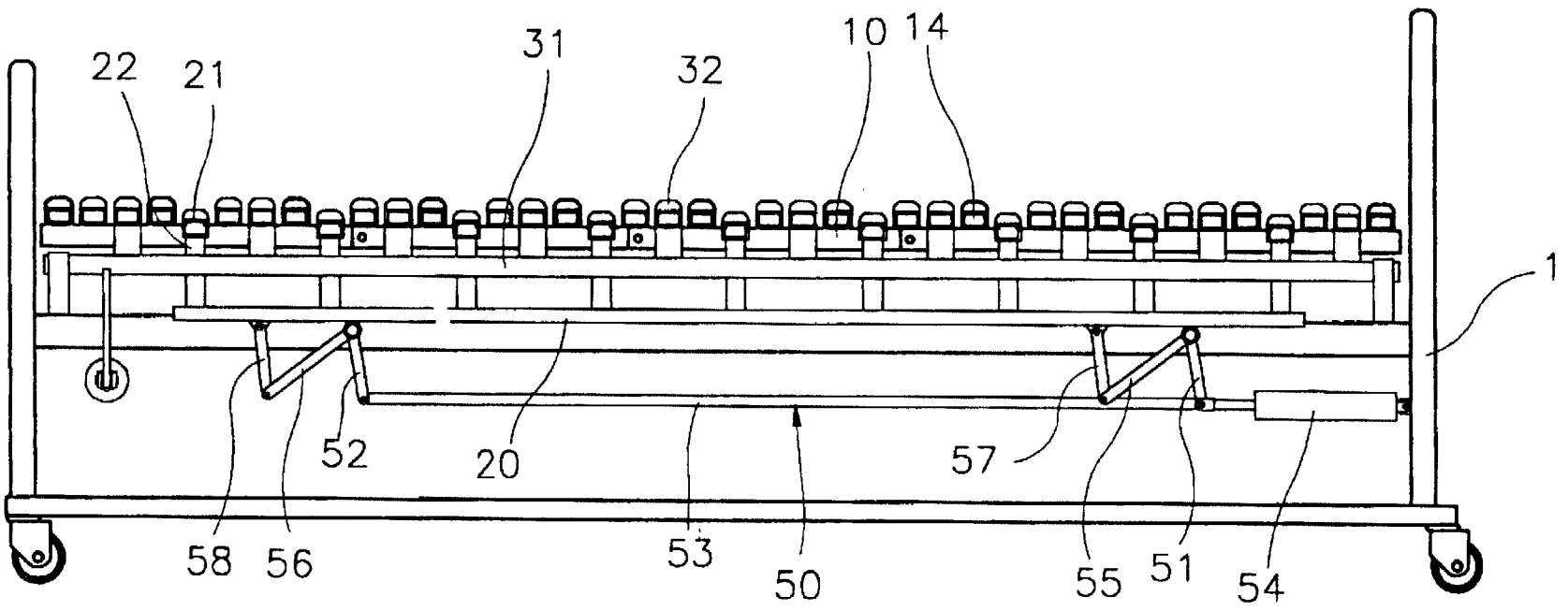

As shown in FIG. 5, when the movable bed planks 21 protrude from the fixed bed planks 14, the weight of the patient is carried by the movable bed planks 21. As shown in FIG. 6, when the movable bed planks 21 return to a low position, the weight of the patient is again carried by the fixed bed planks 14. By shifting the second bed frame with the movable bed planks 21 by means of the first driving device 50 up and down, the patient's body parts on the fixed bed planks 14 and on the movable bed planks 21 are alternatingly exposed to pressure. So the patient's body parts that are in contact with the bed interchange, not allowing certain body parts to be exposed to pressure for long. A gap is also left for ventilation, therefore the patient's blood circulation is furthered, and bedsore is prevented.

Figure 7:
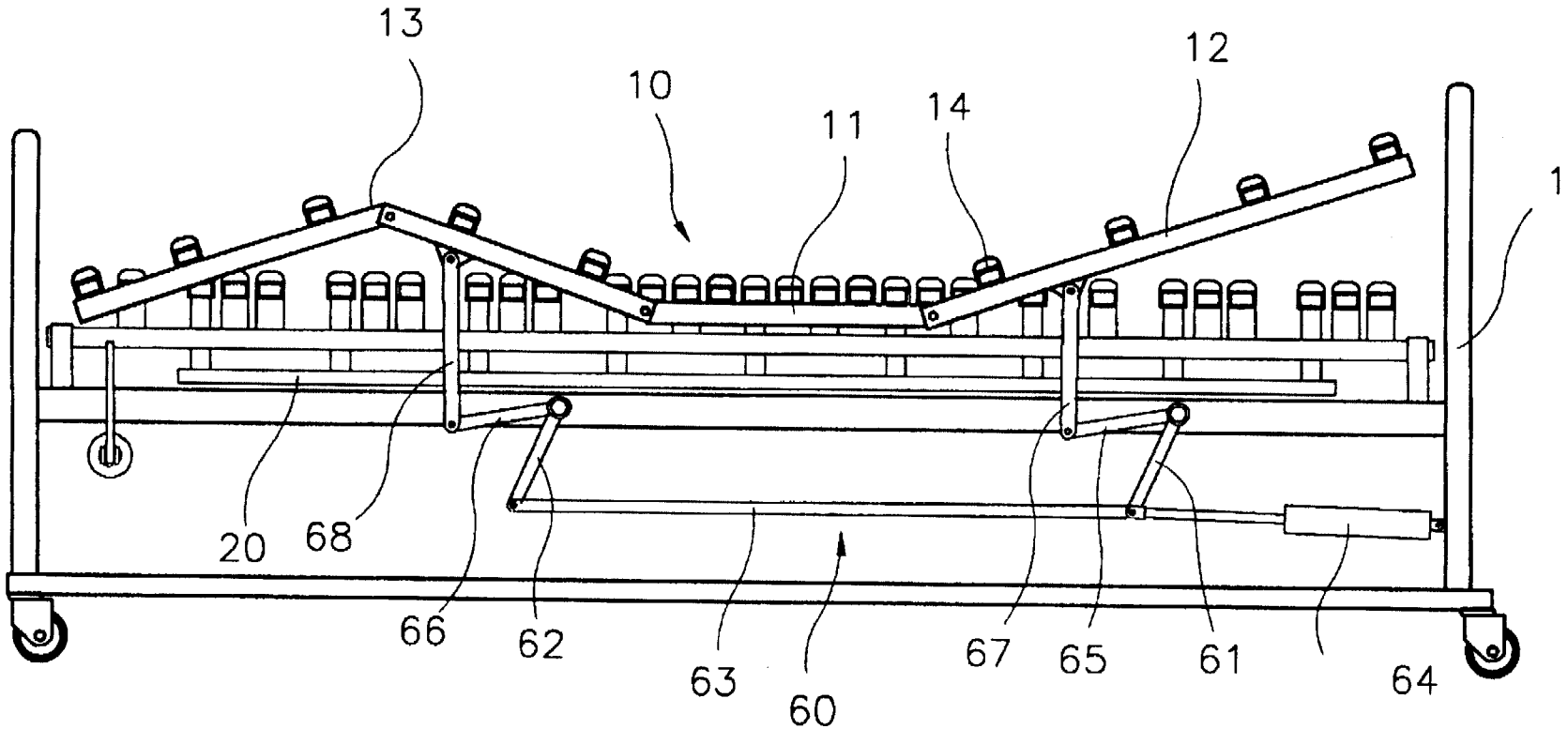
FIG. 7 is a schematic elevational view, leaving out the first driving device, to show the structure of the second driving device used to drive the first bed frame as well as the movement of the first bed frame.

As shown in FIG. 7, the second driving device 60, which is used to drive the first bed frame 10 is, similarly to the first driving device 50, provided with toggle links 61 and 62, links 65 and 66, a link shaft 63, and a power device 64. As shown in FIG. 7, on the back end of the links 65 and 66 two link rods 67 and 68 are used, respectively, to connect to the first and the second movable part 12 and 13 of the first bed frame 10, respectively. So, when the power device 64 drives toggle links 61 and 62, the first and the second movable part 12 and 13 of the first bed frame 10 will by way of link rods 67 and 68 be brought up to an inclined state, changing the posture of the patient or letting the patient sit up.

Figure 8:
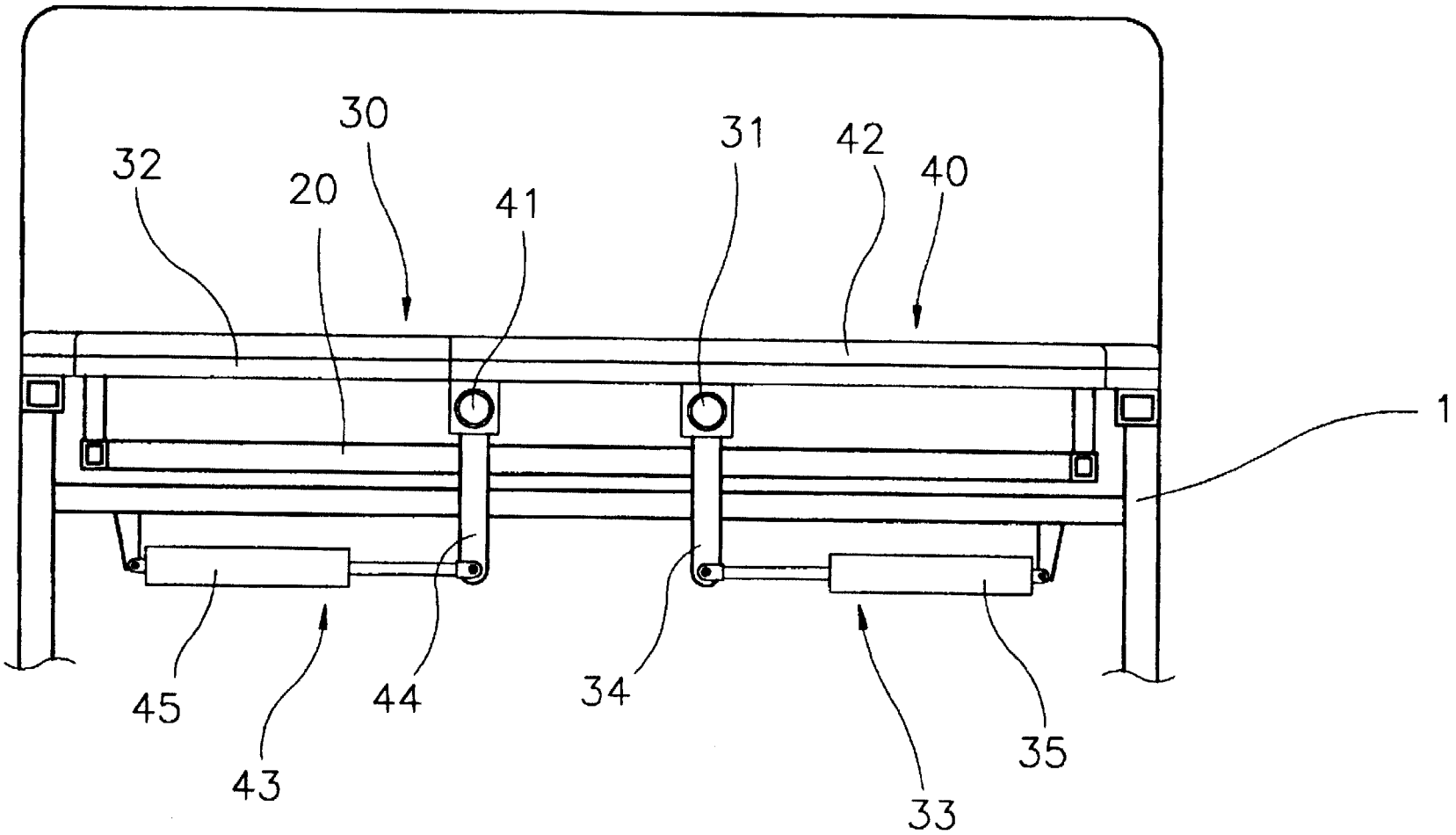
FIG. 8 is a schematic cross-sectional view to show the structure of this invention's lateral turning frame.

The main characteristic of this invention consists in two lateral turning frames, which are additionally provided. As shown in FIG. 2 and 8, the two lateral turning frames 30 and 40 are each provided with: a shaft 31 or 41, respectively, which is installed parallel to the longitudinal axis of the base frame 1; a plurality of support planks 32 or 42, respectively, which are mounted on the top of the shafts 31 and 41, being parallel to each other; and two driving devices 33 and 43, which are used to separately drive the rotary motion of the shafts 31 and 41.

Figure 9:
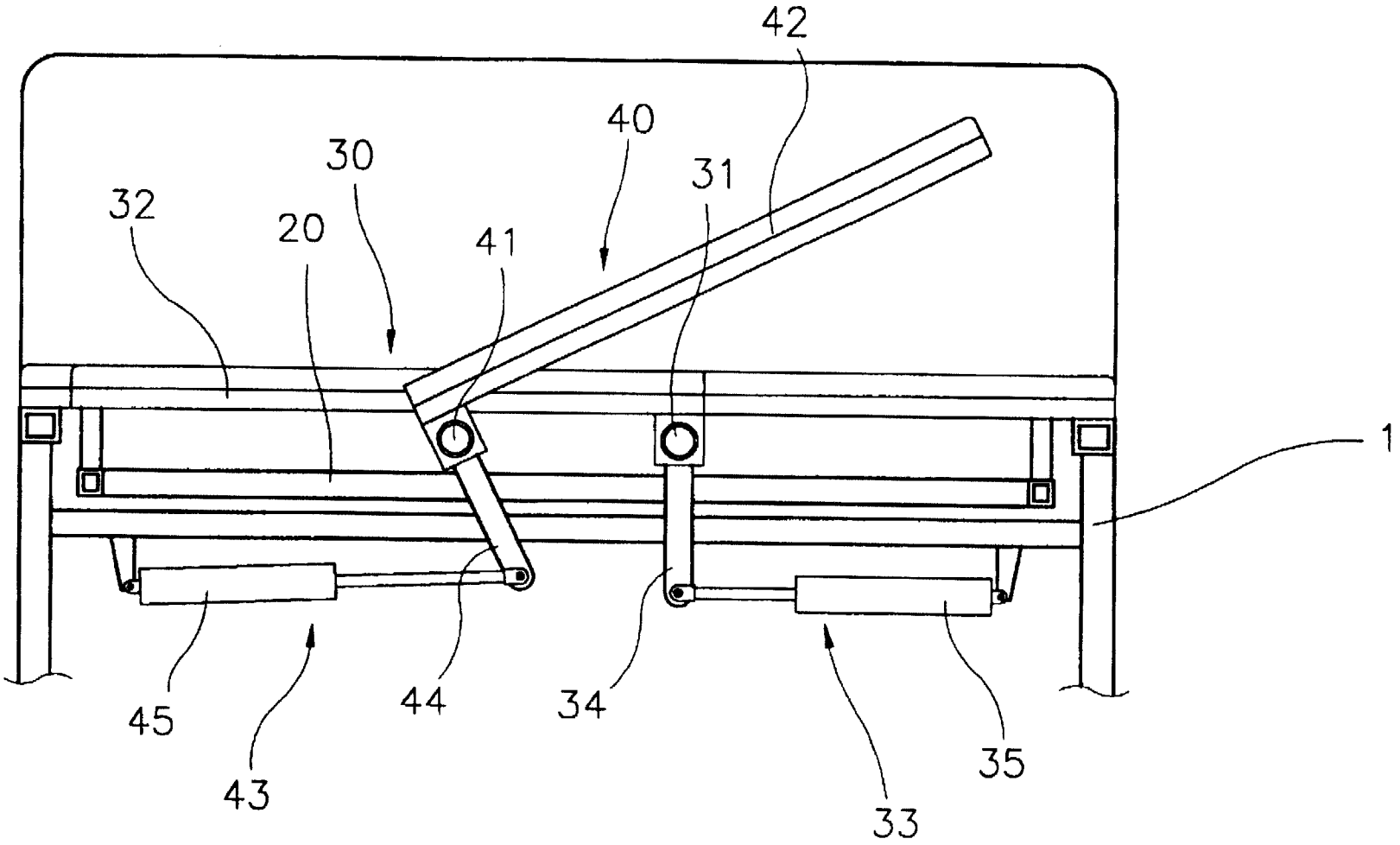
FIG. 9 is a schematic cross-sectional view to show the movement of this invention's lateral turning frame.

The support planks 32 and 42 are with a mutual distance arranged in gaps left by the fixed bed planks 14 and the movable bed planks 21. As shown in FIG. 9, when the patient shall turn, a rotary motion of shaft 31 or shaft 41 will be driven by means of driving device 33 or 43. Then support planks 32 or 45 will move with shaft 31 or 41 as a rotational axis and be elevated by a certain angle. Thereby support planks 32 or 42 will turn the patient's body to the left or to the right.

The driving devices 33 and 43, used to drive the lateral turning frames 30 and 40, respectively, mainly comprise: two levers 34 and 44, which are attached to shaft 31 and shaft 41, respectively; and two pressured liquid/gas vessels 35 and 45, the one end of each being linked to the base frame 1 and the other end being linked to the free end of lever 34 and 44, respectively. As pressurized liquid/gas vessel 35 or 45 drives lever 34 or 44, shaft 31 or 41 will rotate, elevating support planks 32 or 42 to an inclined state to turn the patient.

This invention's fixed bed planks 14, movable bed planks 21 and support planks 32 and 42 are all covered with a strip-like soft mattress to allow the patient to lie comfortably. Moreover, a strip-like soft mattress will cover the whole area of the fixed bed planks 14, the movable bed planks 21 and the support planks 32 and 42 continuously.

This invention's sickbed takes advantage of the movable bed planks 21 to avoid certain parts of the patients body to be pressed for too long, to increase ventilation and to further blood circulation in the patient's body. With the second driving device 60 driving the movable parts 12 and 13 of the first bed frame 10, the patient's posture will be changed, he will sit up or lie inclined. Finally, the lateral turning frames 30 and 40 change a flat-lying state of the patient into a turned-left or turned-right state. So the parts of the patient's body undergoing pressure will be constantly changed.

The combination of this invention's devices will effectively prevent bedsore. Furthermore it can help the patient to sit up and to turn around, thus changing the patient's posture. There will be some degree of motion, preventing muscular atrophy. This is advantageous for the nursing efforts on the patient.

What is more, all devices of this invention operate automatically. So nurses and relatives taking care of the patient can easily pursue their efforts. Additionally, this invention's driving devices 50, 60 and the driving devices 33 and 43 work together as a single automatically controlled system. By means of the single automatically controlled system, every driving device uses its own time-scale to drive automatically the first driving device 10, the second driving device 20, and the lateral turning frames 30 and 40, preventing the effects of a possible negligience by the nursing personnel. The automatic control system even co-ordinates the single movements of each system to attain the states of lying in an inclined position, raising the legs, turning and massaging in a row and thus to move the patient's body parts. When the patient sleeps, the first driving device 10 will stay fixed, and the time cycle of the second driving device 50 and the lateral turning frames 30 and 40 will be lengthened to leave the patient comfortable. A manually operated system to fix the first bed frame in a certain state, when visitors come, can be additionally installed.

Figure 10:
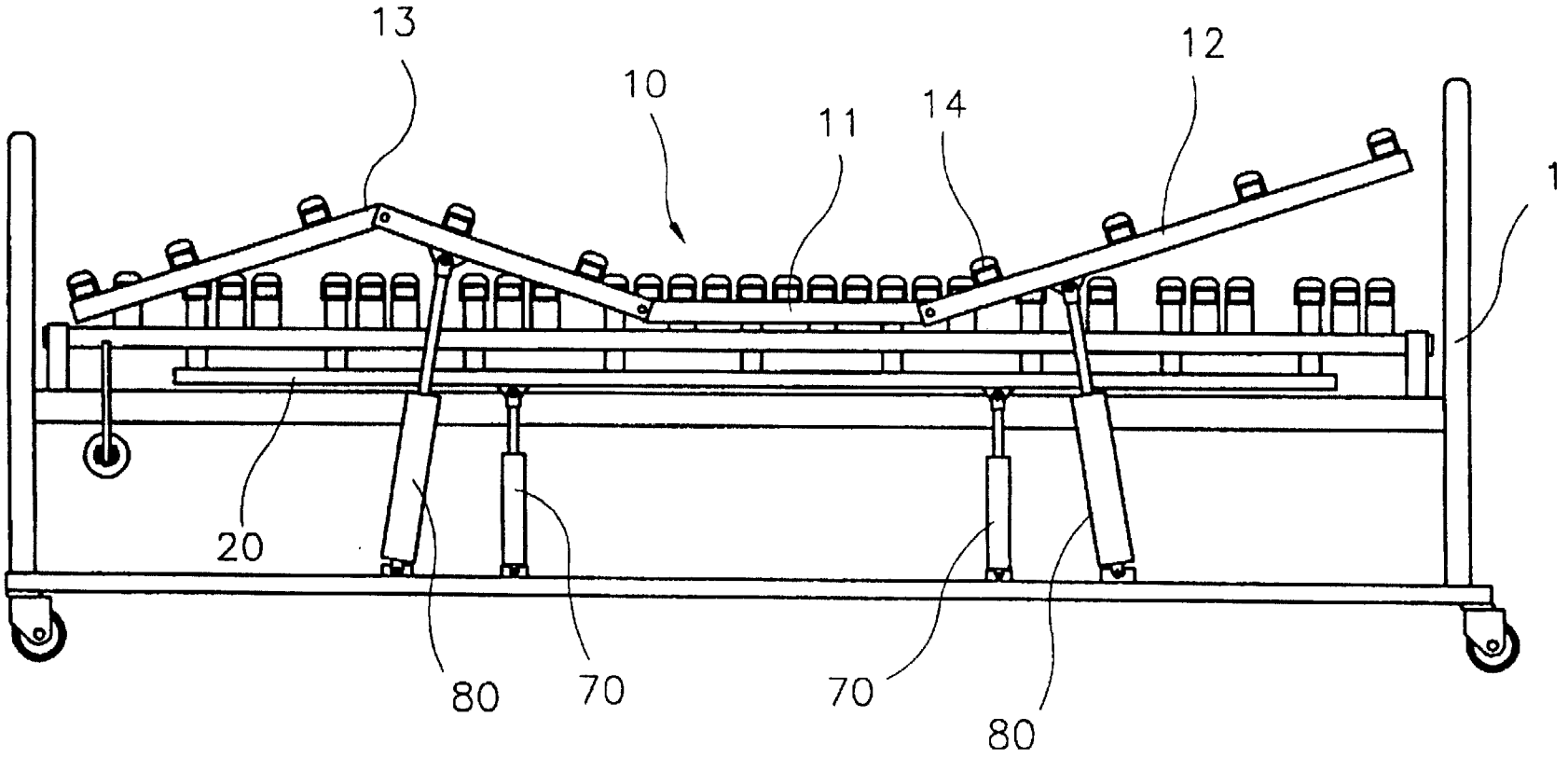
FIG. 10 is a schematic elevational view of a second embodiment of this invention's sickbed to show the structure of the driving devices for the bed frames in another embodiment.

FIG. 10 shows this invention's structure in a second embodiment. In the second embodiment the first and second driving devices for the second and first bed frame have been changed into several pressurized liquid/gas vessels 70 and 80, which are mounted on the bottom side of the second and the first bed frame, respectively, and directly drive the second and the first bed frame. The biggest advantage of this embodiment is that no system of toggle links are needed, simplifying the sickbed's construction and avoiding noise during the movement of the bed frames.

What is claimed is:

1. A sickbed comprising:

a base frame, a first bed frame mounted on said base frame, said first bed frame includes a plurality of fixed bed planks, said fixed bed planks are deployed in positions perpendicular to a longitudinal axis of said first bed frame, a second bed frame that is movable up and down, said second bed frame is mounted below said first bed frame, said second bed frame includes a plurality of movable bed planks, said movable bed planks are deployed in positions perpendicular to a longitudinal axis of said second bed frame, said movable bed planks are interspersed between said fixed bed planks, a first driving device to control up and down movement of said second bed frame, two lateral turning frames adapted to help turn a body of a patient, each said lateral turning frame comprises a shaft mounted parallel to a longitudinal axis of said base frame and a plurality of support planks, said support planks are deployed in positions perpendicular to a longitudinal axis of said lateral turning flame, said support planks being interspersed between said fixed bed planks, and a second driving device to control raising of outer ends of said support planks of said lateral turning frames so as to create a plane inclined from a center of said sickbed to urge said body of said patient to roll toward said center of said sickbed; wherein said movable bed planks raise above or drop below a plane of said fixed bed planks to form alternate planes of support for said patient's body, thereby changing the areas of said patient's body subjected to pressure, and said outer ends of said support planks raise to urge said patient's body toward said center of said sickbed.

2. The sickbed as claimed in claim 1 wherein:

said first driving device further comprises a toggle link to control said up and down movement of said second bed frame and a power device to drive said toggle link.

3. The sickbed as claimed in claim 1 wherein:

said first driving device comprises a plurality of pressurized fluid vessels mounted on a bottom side of said second bed frame.

4. The sickbed as claimed in claim 1 wherein:

said first bed frame further comprises;

a central part fixed on said base frame, a first movable part hingedly mounted on a front end of said central part so as to support said patient's upper body and to incline said patient's upper body as a distal end of said first movable part is raised, and a second movable part which is hingedly mounted on a back end of said central part so as to support said patient's lower body and so as to raise said patient's lower body as a distal end of said second movable part is raised.

5. The sickbed as claimed in claim 1 wherein:

said second driving device comprises a lever attached to said shaft of each said lateral turning frame and a pressurized fluid vessel to drive said lever.

6. The sickbed as claimed in claim 4 wherein:

a third driving device raises and lowers said first and said second movable parts.

7. The sickbed as claimed in claim 6 wherein:

said third driving device comprises a toggle link to control the raising of said first and said second movable parts and a power device to drive said toggle link.

8. The sickbed as claimed in claim 7 wherein:

said third driving device comprises a plurality of pressurized fluid vessels mounted on a bottom side of said first bed frame.

* * * * *